US007256807B2

(12) United States Patent
Goto et al.

(10) Patent No.: US 7,256,807 B2
(45) Date of Patent: Aug. 14, 2007

(54) THERMAL PRINTER

(75) Inventors: Takashi Goto, Tokyo (JP); Shinichiro Suzukawa, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 164 days.

(21) Appl. No.: 11/158,143

(22) Filed: Jun. 21, 2005

(65) Prior Publication Data

US 2005/0285925 A1 Dec. 29, 2005

(30) Foreign Application Priority Data

Jun. 24, 2004 (JP) ..... 2004-186787

(51) Int. Cl.
*B41J 25/304* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS 5,959,651 A 9/1999 Nagahata et al.
6,392,682 B2 * 5/2002 Ozawa ..... 347/223

FOREIGN PATENT DOCUMENTS

| | | | |
|---|---|---|---|
| JP | 05-138982 | * 6/1993 | ..... 347/197 |
| JP | 8-276634 | 10/1996 | |
| JP | 09-188027 | * 7/1997 | |
| JP | 10-202927 | * 8/1998 | |
| JP | 2002-144616 | 5/2002 | |

OTHER PUBLICATIONS

Office Action dated Mar. 9, 2007 for corresponding Chinese Patent Application No. 2005 10079109.X.

* cited by examiner

*Primary Examiner*—Huan Tran
(74) *Attorney, Agent, or Firm*—Brinks Hofer Gilson & Lione

(57) ABSTRACT

A thermal printer includes a platen roller having both ends supported by a frame, a line thermal head having a plurality of heater elements and coming into contact with and separating from the platen roller, and a head mount supporting the line thermal head. The line thermal head has a heat sink mounted thereto for dissipating heat generated from the heater elements during printing on a recording sheet. The heat sink includes a first heat sink portion supported by the line thermal head through the head mount and a second heat sink portion which is connected to the first heat sink portion with a connector and which is removable.

5 Claims, 2 Drawing Sheets

THERMAL PRINTER

This application claims the benefit of priority to Japanese Patent Application No. 2004-186787, filed on Jun. 24, 2004, herein incorporated by reference.

BACKGROUND OF THE INVENTION

1. Field of the Invention

The present invention relates to a thermal printer, and, more particularly, to a thermal printer which can print a high-quality image by properly dissipating heat generated by a line thermal head.

2. Description of the Related Art

Referring to FIG. 3, a related thermal printer 31 has a platen roller 32 and a line thermal head 33 disposed in a frame 31*a*. The line thermal head 33 is situated above the platen roller 32. A recording sheet 34 is transported between the line thermal head 33 and the platen roller 32.

The line thermal head 33 is mounted to a long head mount 35. Respective ends of a pair of head levers 36 are mounted to both ends of the head mount 35 in a longitudinal direction thereof.

The illustrated right end of each head lever 36 is supported by a rotary shaft 37 fixed to a side plate of the frame 31*a*, so that an end of each head lever 36 to which the line thermal head 33 is mounted is rotatable around the rotary shaft 37 serving as a fulcrum.

An ink ribbon 39 accommodated in a ribbon cassette 38 is routed between the platen roller 32 and the line thermal head 33.

A sheet-feed roller 40 and a press-contact roller 41 are disposed on the left of the platen roller 32. A recording sheet 34 press-contacted and nipped between the sheet-feed roller 40 and the press-contact roller 41 can be transported in the direction of arrow A (corresponding to the direction of transportation of the recording sheet 34 when printing is to be performed) or in the direction of arrow B opposite to the direction of arrow A.

A ribbon separating member 43 is, through a heat insulator 42, disposed downstream from the head mount 35 in the direction of transportation of the recording sheet 34.

A printing operation of the related thermal printer 31 will be described.

With the line thermal head 33 being separated from the platen roller 32 in a head-up state as a result of clockwise rotation of the head levers 36, the ribbon cassette 38 is mounted in the frame 31*a*. This causes the ink ribbon 39 to be routed between the platen roller 32 and the line thermal head 33.

Next, a recording sheet is fed in the direction of arrow B by a sheet-feed mechanism (not shown) and is nipped between the sheet-feed roller 40 and the press-contact roller 41. From this state, the recording sheet 34 is further transported in the direction of arrow B by the sheet-feed roller 40 and the press-contact roller 41 to a location between the line thermal head 33 and the platen roller 32.

When a starting position of the recording sheet 34 is located by transporting an edge 34*a* of the recording sheet 34 up to the vicinity of the sheet-feed roller 40, the line thermal head 33 press-contacts the platen roller 32 with the ink ribbon 39 and the recording sheet 34 in between so as to be in a head-down state.

Selectively heating a plurality of heater elements of the line thermal head 33 while transporting the recording sheet 34 in the direction of arrow A with the line thermal head 33 in the head-down state causes ink of the ink ribbon 39 to be thermally transferred to the recording sheet 34, so that a predetermined image is printed on the recording sheet 34.

Here, the ink ribbon 39 which has been made hot for performing the printing is cooled by the time it reaches the ribbon separating member 43 with which the ink ribbon 39 comes into sliding contact, and is properly separated when it is cooled. The heat insulator 42 disposed between the line thermal head 33 and the ribbon separating member 43 can prevent the heat of the line thermal head 33 from being transmitted to the ribbon separating member 43. Refer to Japanese Unexamined Patent Application Publication No. 2002-144616.

Although, in the related thermal printer 31, the heat that is generated by the line thermal head 33 when printing is performed is transmitted to the head mount 35 and is dissipated, the heat cannot be dissipated quickly enough from the head mount 35 when high-speed printing is carried out, causing the temperature of the line thermal head 33 to be equal to or greater than a predetermined value. Therefore, unnecessary ink is transferred from the ink ribbon 39, causing, for example, a thread-forming phenomenon to occur, that is, streaks to be produced in an image printed on the recording sheet 34. This may reduce print quality.

SUMMARY OF THE INVENTION

Accordingly, it is an object of the present invention to provide a thermal printer which can print a high-quality image by properly dissipating heat generated from a line thermal head with two heat sinks.

According to the present invention, there is provided a thermal printer comprising a platen roller having both ends supported by a frame, a line thermal head having a plurality of heater elements and coming into contact with and separating from the platen roller, and a head mount supporting the line thermal head. The line thermal head has a heat sink mounted thereto for dissipating heat generated from the heater elements during printing on a recording sheet. The heat sink includes a first heat sink portion supported by the line thermal head through the head mount and a second heat sink portion which is connected to the first heat sink portion with a connector and which is removable.

In a first form, the line thermal head is supported by a head lever that is rotatable by being supported by a post supported by opposing side plates of the frame, a first end of the second heat sink portion is removable from the first heat sink portion supported by the line thermal head, and a second end of the second heat sink portion is supported by the post and rotates as the head lever rotates.

In a second form based on the first form, the post includes a first post portion supported by one of the side plates of the frame and a second post portion supported by the other side plate of the frame, and the second end of the second heat sink portion has a support hole capable of being inserted onto and removed from the first and second post portions.

In a third form based on the second form, the second heat sink portion has support holes, one in each of first and second supporting plates opposing each other and being separated by a predetermined interval, and the second heat sink portion is moved in a first direction by inserting the support hole disposed in the first supporting plate onto the first post portion and is, then, moved in a second direction in order to insert the support hole disposed in the second supporting plate onto the second post portion, so that the second heat sink portion is supportable by the first and second post portions.

In a fourth form based on the third form, when the second heat sink portion supported by the first and second post portions is moved in the first direction, the second supporting plate is removed from the second post portion, and, when the second heat sink portion is then moved in the second direction, the first supporting plate is removed from the first post portion, so that the second heat sink portion is removable from the first and second post portions.

Since the thermal printer according to the present invention includes a first heat sink portion mounted to the line thermal head through the head mount and a second heat sink portion which is connected to the first heat sink portion with a connector and which is removable, the heat dissipation areas of the heat sink portions can be large, so that heat generated by the thermal head during printing can be properly dissipated. Therefore, a thermal printer which can print a high-quality image can be provided.

DESCRIPTION OF THE PREFERRED EMBODIMENT

Figure 1:
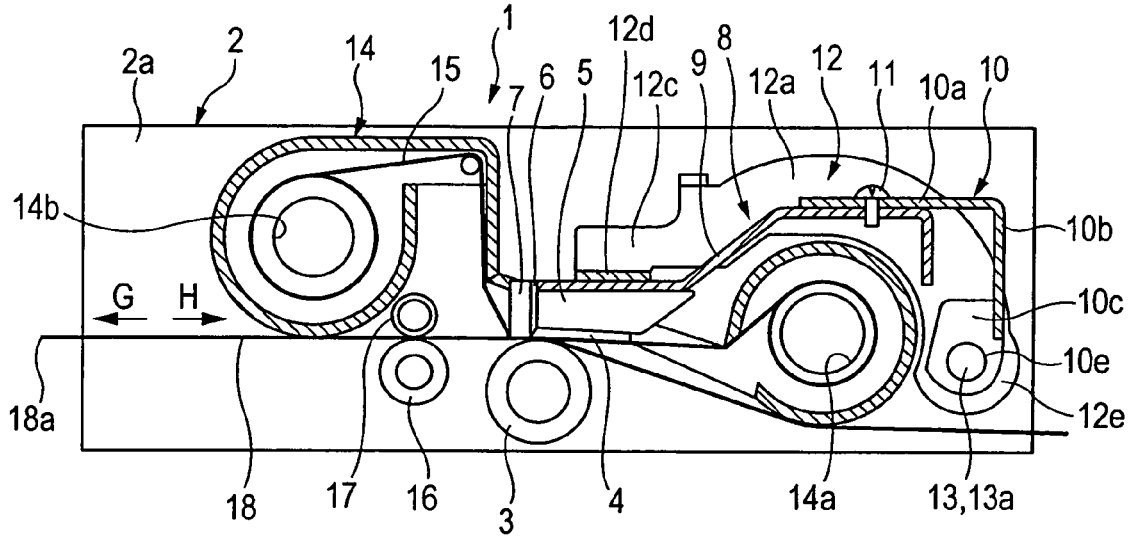
FIG. 1 is a sectional view of the main portion of a thermal printer according to an embodiment of the present invention.

A thermal printer 1 according to an embodiment of the present invention will hereunder be described with reference to FIGS. 1 and 2. FIG. 1 is a sectional view of the main portion of the thermal printer according to the embodiment of the present invention, and FIG. 2 is a right side view of FIG. 1.

Figure 2:
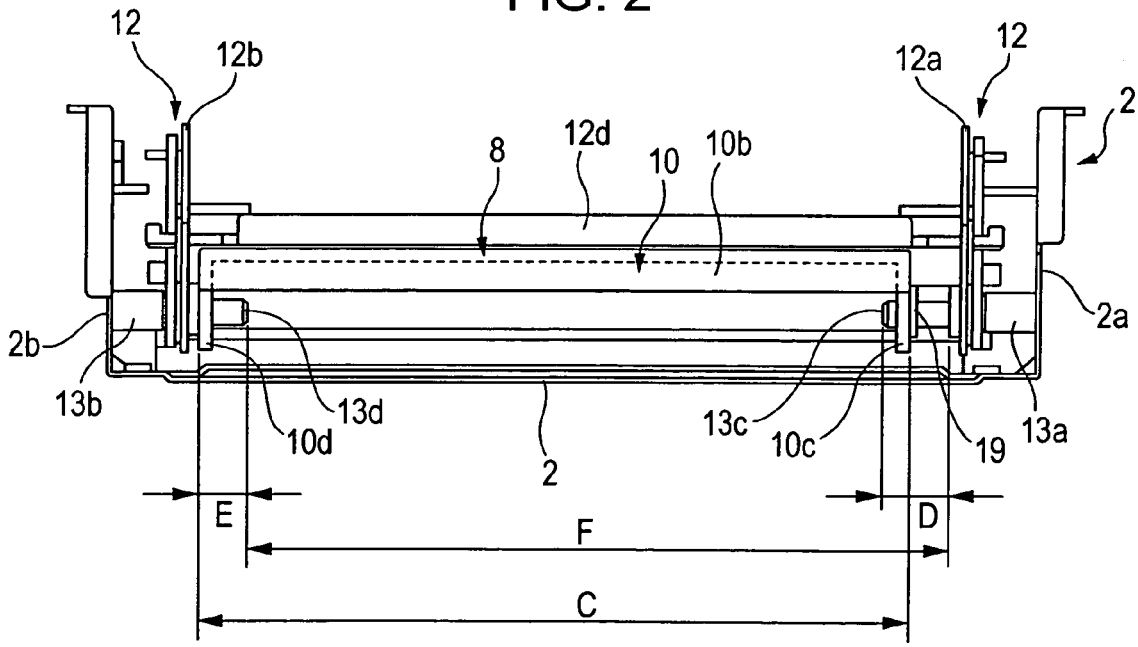
FIG. 2 is a right side view of FIG. 1.
Figure 3:
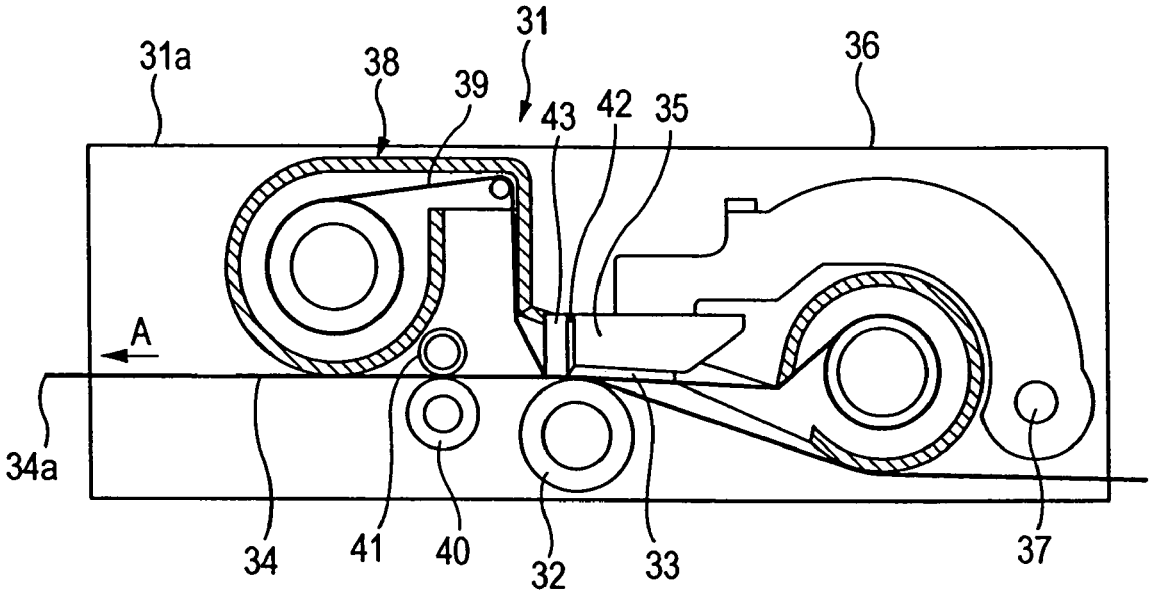
FIG. 3 RELATED ART
FIG. 3 is a sectional view of the main portion of a related thermal printer.

As shown in FIGS. 1 and 2, the thermal printer 1 according to the present invention includes a frame 2 and a long cylindrical platen roller 3. The frame 2 has opposing side plates 2*a* and 2*b* that are separated from each other by a predetermined interval. The platen roller 3 is rotatably supported at the opposing side plates 2*a* and 2*b*.

A long line thermal head 4 is disposed in the frame 2 so as to be situated above the platen roller 3 and so as to extend along a longitudinal direction of the platen roller 3. The line thermal head 4 has a plurality of heater elements (not shown) disposed in a row in the longitudinal direction and opposing the plate roller 3.

The line thermal head 4 is mounted to a long head mount 5 formed of a metal, such as aluminum, having good thermal conductivity. A ribbon separating member 7 is mounted on the left of the head mount 5 in the figure through a heat insulator 6.

A heat sink 8 formed of a metallic plate, such as an aluminum plate, having an excellent heat-dissipation property is mounted to the top surface of the head mount 5.

The heat sink 8 includes a first heat sink portion 9 having one end portion mounted in close contact with the top surface of the head mount 5 and a second heat sink portion 10 removably mounted to the other end portion of the first heat sink portion 9.

The second heat sink portion 10 has a substantially L shape, and has a first heat dissipation portion 10*a* and a second heat dissipation portion 10*b* at respective end portions. The left and right ends (separated by a width C) of the second heat-dissipation portion 10*b* in the longitudinal direction shown in FIG. 2 are bent so as to oppose each other, so that respective supporting plates 10*c* and 10*d* are formed. Support holes 10*e* capable of being inserted on and removed from a post 13 (described later) are formed in the supporting plates 10*c* and 10*d*, respectively.

The second heat sink portion 10 has the width C between the opposing supporting plates 10*c* and 10*d*. The second heat sink portion 10 is such that its first heat dissipation portion 10*a* is connected to the first heat sink portion 9 with a connector 11, such as a screw, so as to be removable from the other end portion of the first heat sink portion 9.

The line thermal head 4 is supported by a head lever 12 through the head mount 5 and the first heat sink portion 9.

The head lever 12 has a first lever portion 12*a* and a second lever portion 12*b*. The first lever portion 12*a* and the second lever portion 12*b* are substantially U-shaped, oppose each other, are separated by a predetermined interval, and are connected and integrated with each other at a head support 12*d* disposed at left ends 12*c* shown in FIG. 1. The thermal head 4 is supported below the head support 12*d* through the first heat sink portion 9 and the head mount 5.

Right ends 12*e* of the head lever 12 shown in FIG. 1 are supported in a cantilever manner at the post 13 supported at the side plates 2*a* and 2*b* of the frame 2.

As shown in FIG. 2, the post 13 includes a first post portion 13*a* and a second post portion 13*b*. The first post portion 13*a* can be inserted into and removed from the side plate 2*a*, and the second post portion 13*b* is, for example, press-fitted to the side plate 2*b*.

The first post portion 13*a* is secured to, for example, a plate (not shown) where a motor (not shown) for driving ascending/descending means for raising and lowering the head lever 12 is mounted. When the plate is mounted to the side plate 2*a*, the first post portion 13*a* is perpendicularly disposed inside the side plate 2*a* so as to support the lever portion 12*a* of the head lever 12.

The second post portion 13*b* is perpendicularly disposed inside the side plate 2*b* so as to support the lever portion 12*b*.

The first post portion 13*a* and the second post portion 13*b* have a first thin shaft 13*c* and a second thin shaft 13*d*, respectively. The first thin shaft 13*c* can be inserted into the support hole 10*e* in the supporting plate 10*c*, and the second thin shaft 13*d* can be inserted into the support hole 10*e* in the supporting plate 10*d*.

The first thin shaft 13*c* of the first post portion 13*a* has a length D, and the second thin shaft 13*d* of the second post portion 13*b* has a length E which is less than the length D (that is, D>E).

A length F from a base of the first thin shaft 13*c* of the first post portion 13*a* to an end of the second post portion 13*b* is greater than the width C in the longitudinal direction of the second heat sink portion 10. In other words, F>C.

Therefore, the support hole 10*e* of the supporting plate 1*c* is inserted onto the first thin shaft 13*c* of the first post portion 13*a* in order to move the second heat sink portion 10 in one direction, that is, towards the right in FIG. 2 before the second heat sink portion 10 is connected to the first heat sink portion 9 with the connector 11. Then, the second heat sink portion 10 is moved in the other direction, that is, towards the left in FIG. 2 in order to insert the support hole 10*e* of the supporting plate 10d onto the second thin shaft 13*d* of the second post portion 13*b*, as a result of which the second heat sink portion 10 is supported by the first post portion 13*a* and the second post portion 13*b*.

When the second heat sink portion 10 is moved leftwards, the first heat dissipation portion 10*a* is connected with the other end portion of the first heat sink portion 9 with the connector 11, and an E ring 19 is fitted to the first thin shaft 13*c* disposed outwardly of the supporting plate 10*c*, so that the second heat sink portion 10 is supported by the post 13 so as to restrict its leftward and rightward movements.

Since the horizontal and vertical movements of the heat sink 8 are restricted as a result of the second heat sink portion 10 being supported by the post 13, even if, for example, an external vibration is applied to the heat sink 8, it is possible to prevent, for example, deformation of the heat sink 8.

By vertically moving the ends 12*c* of the head lever 12 (whose ends 12*e* are supported by the post 13) with the ascending/descending means (not shown), the head lever 12 rotates around the post 13 as fulcrum in order for the line thermal head 4 to come into contact with or separate from the platen roller 3, that is, to be set in a head-up state or a head-down state.

An ink ribbon 15 accommodated in a ribbon cassette 14 is routed between the platen roller 3 and the line thermal head 4. Ends of the ink ribbon 15 are wound upon a supply reel 14*a* and a take-up reel 14*b* in the ribbon cassette 14.

A rotationally drivable sheet-feed roller 16 and a press-contact roller 17 coming into press-contact with the sheet-feed roller 16 are disposed on the left of the platen roller 3 in FIG. 1.

When the line thermal head 4 is in the head-up state in which it is separated from the platen roller 3, a recording sheet 18 fed in the direction of arrow H is press-contacted and nipped between the sheet-feed roller 16 and the press-contact roller 17 and can be transported rightwards by clockwise rotation of the sheet-feed roller 16.

When the recording sheet 18 is fed in the direction of arrow H and an edge 18*a* of the recording sheet 18 is transported to the vicinity of the sheet-feed roller 16, a sheet detecting sensor (not shown) detects the edge 18*a* in order to stop the rotation of the sheet-feed roller 16, so that the feeding of the recording sheet 18 in the direction of arrow H is stopped.

In the thermal printer 1 according to the present invention, the head lever 12 is assembled by first mounting the head mount 5 and the thermal head 4 to the head support 12*d* adjacent the ends 12*c* of the head lever 12 through the first heat sink portion 9. Then, the lever portion 12*b* of the head lever 12 is supported by the second post portion 13*b* perpendicularly disposed at the inner side from the side plate 2*b*. Thereafter, when the plate (not shown) to which the first post portion 13*a* is fixed is mounted to the side plate 2*a*, the first post portion 13*a* is perpendicularly disposed at the inner side from the side plate 2*a*.

The lever portion 12*a* of the head lever 12 is supported by the first post portion 13*a* perpendicularly disposed at the inner side from the side plate 2*a*.

Accordingly, the head lever 12 is rotatable around the post 13 as fulcrum, so that the ends 12*c* of the head lever 12 can move vertically.

When the support hole 10*e* of the supporting plate 10*c* of the second heat sink portion 10 is inserted on the first thin shaft 13*c* of the first post portion 13*a* in order to move the second heat sink portion 9 rightwards in FIG. 2 and push it to the base of the first thin shaft 13*c*, the outer surface of the left supporting plate 10*d* in FIG. 2 is disposed inwardly of an end of the second post portion 13*b*.

With the support hole 10*e* of the supporting plate 10*d* and the second post portion 13*b* opposing each other, the second heat sink portion 10 is moved leftwards. This causes the support hole 10*e* in the supporting plate 10*d* to be inserted onto the thin shaft 13*d* of the second post portion 13*b* in order for the second heat sink portion 10 to be supported by the post 13.

Thereafter, the E ring 19 is fitted to the first thin shaft 13*c* disposed outwardly of the supporting plate 10*c* of the second heat sink portion 10. This restricts the leftward and rightward movements of the second heat sink portion 10.

By connecting the first heat-dissipation portion 10*a* of the second heat sink portion 10 to the other end of the first heat sink portion 9 with the connector 11, the first heat sink portion 9 and the second heat sink portion 10 are integrated, as a result of which the head lever 12 is assembled.

When the second heat sink portion 10 is to be removed because it is no longer required due to a change in, for example, a printing condition, the connector 11 connecting the first heat sink portion 9 and the second heat sink portion 10 is removed, and the E ring 19 is removed in order to move the second heat sink portion 10 leftwards in FIG. 2. This causes the support hole 10*e* in the support plate 10*d* of the second heat sink portion 10 to be removed from the second post portion 13*b*. Then, when the second heat sink portion 10 is moved in the other direction, the support hole 10*e* of the supporting plate 10*c* is removed from the first post portion 13*a*, so that the second heat sink portion 10 is removed from the first post portion 13*a* and the second post portion 13*b*.

A printing operation of the thermal printer 1 according to the present invention incorporating the head lever 12 assembled in the above-described manner will be described with reference to FIG. 1. First, the line thermal head 4 is set in the head-up state by rotating the head lever 12 upward, and a recording sheet 18 is fed in the direction of arrow H and is transported rightwards as illustrated to a location between the platen roller 3 and the thermal head 4 by the clockwise rotation of the sheet-feed roller 16. Then, when the edge 18*a* of the recording sheet 18 is transported to the vicinity of the sheet-feed roller 16, a sheet sensor (not shown) is used to locate the starting position of the recording sheet 18, and, then, the rotation of the sheet-feed roller 16 is stopped.

Then, the head lever 12 is rotated counterclockwise as illustrated in order to press-contact the line thermal head 4 with the platen roller 3 through the ink ribbon 15 and the recording sheet 18. In this state, while selectively heating the heater elements of the line thermal head 4 on the basis of printing information, the sheet-feed roller 16 is rotationally driven counterclockwise in order to transport the recording sheet 18 in the direction of arrow G.

Ink of the ink ribbon 15 is transferred onto the recording sheet 18 in order to print a predetermined image on the recording sheet 18. The ink ribbon 15 used in the printing is wound up upon the take-up reel 14*b*.

The heat generated by the line thermal head 4 during the printing is dissipated to the outside by being transmitted to the heat sink 8 having a large area through the head mount 5. Therefore, the line thermal head 4 does not become abnormally hot, so that it is possible to prevent a reduction in print quality and to thus perform printing of a high-quality image.

Although, in the embodiment of the present invention, the second heat sink portion 10 is supported by the post 13 by moving the second heat sink portion 10 in two different directions, the support hole 10*e* of the supporting plate 10*c* can be inserted onto and removed from the first post portion 13*a* by, for example, mounting and dismounting the plate (not shown) to which the first post portion 13*a* is mounted to and from the side plate 2*a*.

What is claimed is:

1. A thermal printer comprising:

a platen roller having both ends supported by a frame;

a line thermal head having a plurality of heater elements, the line thermal head coming into contact with and separating from the platen roller; and a head mount supporting the line thermal head, wherein the line thermal head has a heat sink mounted thereto for dissipating heat generated from the heater elements during printing on a recording sheet, the heat sink including a first heat sink portion supported by the line thermal head through the head mount and a second heat sink portion being connected to the first heat sink portion with a connector and being removable.

2. The thermal printer according to claim 1, wherein the line thermal head is supported by a head lever that is rotatable by being supported by a post supported by opposing side plates of the frame, a first end of the second heat sink portion is removable from the first heat sink portion supported by the line thermal head, and a second end of the second heat sink portion is supported by the post and rotates as the head lever rotates.

3. The thermal printer according to claim 2, wherein the post includes a first post portion supported by one of the side plates of the frame and a second post portion supported by the other side plate of the frame, and the second end of the second heat sink portion has a support hole capable of being inserted onto and removed from the first and second post portions.

4. The thermal printer according to claim 3, wherein the second heat sink portion has support holes, one in each of first and second supporting plates opposing each other and being separated by a predetermined interval, and wherein the second heat sink portion is moved in a first direction by inserting the support hole disposed in the first supporting plate onto the first post portion and is, then, moved in a second direction in order to insert the support hole disposed in the second supporting plate onto the second post portion, so that the second heat sink portion is supportable by the first and second post portions.

5. The thermal printer according to claim 4, wherein, when the second heat sink portion supported by the first and second post portions is moved in the first direction, the second supporting plate is removed from the second post portion, and, when the second heat sink portion is then moved in the second direction, the first supporting plate is removed from the first post portion, so that the second heat sink portion is removable from the first and second post portions.

* * * * *